US011454441B2

(12) United States Patent
Staud et al.

(10) Patent No.: US 11,454,441 B2
(45) Date of Patent: Sep. 27, 2022

(54) DOMESTIC REFRIGERATION APPLIANCE WITH SPECIFIC FRONT-SIDE LOWERING SEGMENT OF A COMPARTMENT FLOOR

(71) Applicant: BSH HAUSGERAETE GMBH, Munich (DE)

(72) Inventors: Ralph Staud, Munich (DE); Thomas Tischer, Haar (DE); Marco Reitwiessner, Munich (DE); Andreas Kessler, Munich (DE); Andreas Korte, Munich (DE)

(73) Assignee: BSH Hausgeraete GmbH, Munich (DE)

( * ) Notice: Subject to any disclaimer, the term of this patent is extended or adjusted under 35 U.S.C. 154(b) by 452 days.

(21) Appl. No.: 16/129,048

(22) Filed: Sep. 12, 2018

(65) Prior Publication Data

US 2019/0078838 A1 Mar. 14, 2019

(30) Foreign Application Priority Data

Sep. 13, 2017 (DE) ..... 10 2017 216 189.2

(51) Int. Cl.

*F25D 25/02* (2006.01)
*F25D 11/02* (2006.01)
*F25D 23/02* (2006.01)

(52) U.S. Cl.

CPC ..... *F25D 25/025* (2013.01); *F25D 11/02* (2013.01); *F25D 23/021* (2013.01); *F25D 2323/02* (2013.01)

(58) Field of Classification Search

CPC ..... F25D 25/025; F25D 11/02; F25D 23/021; F25D 2323/02; E05B 1/00

See application file for complete search history.

(56) References Cited

U.S. PATENT DOCUMENTS 2,434,117 A * 1/1948 Money ..... F25D 17/045 211/153
3,407,016 A * 10/1968 Kronenberger ..... F25D 21/14 312/229
5,441,338 A * 8/1995 Kane ..... A47B 96/025 108/159
5,641,217 A * 6/1997 Caruso ..... F25D 25/025 312/334.23

(Continued)

FOREIGN PATENT DOCUMENTS

CN 102483298 A 5/2012
CN 203940685 U 11/2014

(Continued)

*Primary Examiner* — Hanh V Tran

(74) *Attorney, Agent, or Firm* — Laurence A. Greenberg; Werner H. Stemer; Ralph E. Locher

(57) ABSTRACT

A domestic refrigeration appliance includes a receiving space for food, a drawer in the form of a food container being movable in the receiving space and a compartment floor disposed in the receiving space and forming a cover for the drawer. An elastically deformable stop element which faces a front wall of the drawer is disposed on a front edge of the compartment floor. The compartment floor has a lowering segment on its foremost region which faces the front wall and a foremost rim on which the elastically deformable stop element is disposed. The foremost rim is lowered downward relative to a sheet region of the compartment floor.

14 Claims, 2 Drawing Sheets

(56) References Cited

U.S. PATENT DOCUMENTS

| | | | | |
|---|---|---|---|---|
| 10,132,557 | B2 * | 11/2018 | Caglin | F25D 23/028 |
| 2001/0050521 | A1 * | 12/2001 | Maritan | F25D 23/025 312/408 |
| 2005/0138955 | A1 * | 6/2005 | Okuda | F25D 23/025 62/441 |
| 2008/0302114 | A1 * | 12/2008 | Kelly | F25D 17/042 62/170 |
| 2009/0033188 | A1 * | 2/2009 | Becke | F25D 25/02 312/404 |
| 2009/0308094 | A1 * | 12/2009 | Gorz | F25D 17/065 62/264 |
| 2010/0229592 | A1 | 9/2010 | Lim et al. | |
| 2013/0257253 | A1 * | 10/2013 | Haltmeyer | F25D 25/025 312/404 |
| 2014/0300264 | A1 * | 10/2014 | Park | F25D 25/025 312/404 |
| 2015/0115790 | A1 | 4/2015 | Ogg | |
| 2015/0300724 | A1 * | 10/2015 | Becke | F25D 25/025 312/405 |
| 2017/0122651 | A1 * | 5/2017 | Cizik | F25D 17/06 |
| 2017/0276425 | A1 * | 9/2017 | Fink | F25D 17/042 |
| 2017/0292766 | A1 * | 10/2017 | Lee | F25D 11/02 |
| 2017/0292779 | A1 * | 10/2017 | Lee | A23B 7/015 |
| 2017/0367478 | A1 * | 12/2017 | Ahmedov | A47B 57/58 |
| 2018/0038630 | A1 * | 2/2018 | Biotti | F25D 11/02 |
| 2018/0180351 | A1 * | 6/2018 | Ertik | F25D 25/025 |
| 2018/0187966 | A1 * | 7/2018 | Lee | F25D 25/025 |
| 2018/0224187 | A1 * | 8/2018 | Han | F25D 17/065 |
| 2018/0347871 | A1 * | 12/2018 | Park | F25B 21/04 |

FOREIGN PATENT DOCUMENTS

| | | | |
|---|---|---|---|
| CN | 104344636 | A | 2/2015 |
| CN | 104344669 | A | 2/2015 |
| JP | H09119773 | A | 5/1997 |
| WO | 2015086185 | A1 | 6/2015 |

* cited by examiner

DOMESTIC REFRIGERATION APPLIANCE WITH SPECIFIC FRONT-SIDE LOWERING SEGMENT OF A COMPARTMENT FLOOR

CROSS-REFERENCE TO RELATED APPLICATION

This application claims the priority, under 35 U.S.C. § 119, of German Patent Application DE 10 2017 216 189.2, filed Sep. 13, 2017; the prior application is herewith incorporated by reference in its entirety.

BACKGROUND OF THE INVENTION

Field of the Invention

The invention relates to a domestic refrigeration appliance with a receiving space for food. Moreover, the domestic refrigeration appliance has a drawer in the form of a food container which is disposed so as to be movable in the receiving space. Furthermore, the domestic refrigeration appliance has at least one separate compartment floor which is disposed in the receiving space and which forms a cover for the drawer. An elastically deformable stop element is disposed on a front edge of the compartment floor. The stop element faces a front wall of the drawer.

An embodiment of such a domestic refrigeration appliance is known from International Publication WO 2015/086185 A1, for example. In the embodiments found therein, the compartment floor is disposed in such a way that it extends in one plane. That also means that the foremost region, which faces the front wall of the drawer, and on which the seal found there is realized, is positioned at the height of the upper edge of the front wall of the drawer. Consequently, when the drawer is in the closed state, it is not possible to grasp the front wall at the top. Therefore, it is necessary in that case for the front wall of the drawer to have a handle which protrudes forward, so that the handle can be gripped by a user in order to be able to then pull out the drawer. An embodiment of that type means that the structural space for the front wall of the drawer is relatively large in the depth direction of the domestic refrigeration appliance, with the result that useful space in the drawer is reduced in such a case.

SUMMARY OF THE INVENTION

It is accordingly an object of the invention to provide a domestic refrigeration appliance with a specific front-side lowering segment of a compartment floor, which overcomes the hereinafore-mentioned disadvantages of the heretofore-known appliances of this general type and in which an elastically deformable stop element is disposed better to the extent that it is not undesirably harmed, for example damaged by an impact, during a removal of stored goods from the compartment floor or during an introduction of stored goods onto to the compartment floor.

With the foregoing and other objects in view there is provided, in accordance with the invention, a domestic refrigeration appliance having a receiving space for food. Moreover, the domestic refrigeration appliance has a drawer in the form of a food container which is disposed so as to be movable in this receiving space. Furthermore, the domestic refrigeration appliance has at least one separate compartment floor which is disposed in the receiving space. The compartment floor forms a cover for the drawer and is consequently disposed correspondingly, in particular specifically directly above the drawer in the height direction of the domestic refrigeration appliance. An elastically deformable stop element is disposed on a front edge of the compartment floor as viewed in the depth direction of the domestic refrigeration appliance. This stop element is oriented in such a way that it faces a front wall of the drawer in the depth direction of the domestic refrigeration appliance. The compartment floor has a lowering segment on its foremost region, which faces the front wall of the drawer. As viewed in the depth direction, this lowering segment has a foremost rim which is lowered downward with respect to a sheet region of the compartment floor when viewed in the height direction of the domestic refrigeration appliance. With regard to an embodiment of this type the stop element is also disposed in a protected manner to a certain extent when the drawer is in the closed state, since it is not positioned directly on the upper rim or respectively the upper edge of the front wall of the drawer, but instead is lowered with reference to the same. Consequently, an impacting of stored goods on this elastically deformable stop element during removal or insertion of stored goods, which are disposed on the compartment floor, does not result in this elastically deformable stop element being damaged in such a case. Furthermore, the manipulability of the drawer is also improved as a result.

A very advantageous embodiment provides that when the drawer is in the closed state a handle recess which can be engaged from above is formed by the lowering segment and the front wall of the drawer. This is very advantageous to the extent that therefore a front-side handle does not need to be realized on the front wall of the drawer, which reduces the construction space in the depth direction and would therefore reduce the useful volume of the drawer. Moreover, a very ergonomic and therefore user-friendly operation is also enabled by using this embodiment, since a user then intuitively grips the front wall from above and therefore also grips it at the back in order to be able to safely push in or pull out the drawer in a linear manner in the depth direction. Both when pulling out, in particular starting from the drawer being in the closed state, safe and extensive gripping can therefore be effected from above and therefore also slipping of a user off the front wall is prevented. Likewise, this prevents users from trapping their fingers when pushing the drawer in if, in such a case, they absentmindedly grab around the front wall above its upper region and push the drawer in. The lowering segment then results in the user's fingers not being trapped between the front wall and the stop element even when in the closed state.

Preferably, the stop element is realized in the form of a damping element through the use of which damping is also effected by the deformation during contact with the drawer. A hard impact of the drawer on the compartment floor is prevented as a result.

Provision is preferably made that when the drawer is in the closed state the elastically deformable stop element abuts against a rear side of the front wall of the drawer and, when viewed in the height direction of the domestic refrigeration appliance, offset downward with respect to an upper edge of the front wall. The advantages achievable with reference to the positions have already been set forth above. On the other hand, this abutting of the elastically deformable stop element against this rear side of the front wall then also enables safe closing so that no media can unintentionally get into the useful volume of the drawer. This is also achieved precisely by using the elastically deformable element if production tolerances or position tolerances were to arise between the drawer and the lowering segment.

In a further, very advantageous, embodiment provision is made that this elastically deformable stop element is a seal. The advantages set forth above are again improved as a result and an entry of media into the useful volume of the drawer and also an escape of media from the drawer through this interface between the rear side and the front wall of the drawer and the lowering segment is prevented as a result. This can be advantageous in particular whenever specific foods are stored and/or specific storage conditions are set in the useful space of the drawer. On one hand, the escape of aromas from the stored goods in the drawer to other regions of the domestic refrigeration appliance, in particular to a receiving space, can therefore then be prevented, and on the other hand, a quite specific and individual storage of the stored goods in this drawer can be maintained on a long-term basis.

Provision is preferably made that the elastically deformable stop element is realized in a U-shape as seen in a cross-section perpendicular to a longitudinal axis of this stop element, in particular being realized in the form of a U lying on its side. This stop element is realized with reduced weight and the deformation elasticity is provided particularly advantageously as a result.

However, a different cross-sectional shape, for example an L-shape, can also be provided.

In an advantageous embodiment the compartment floor has a sheet region which, when viewed in the depth direction of the domestic refrigeration appliance, has a foremost edge. Moreover, the compartment floor has a strip which is separate from the sheet region and which is disposed on this foremost edge. The lowering segment is integrated in this strip and therefore realized in a single piece with this strip. An embodiment of this type makes it possible to be able to individually manufacture the more complex-shaped part in the shape of the strip with the lowering segment. Simple manufacturing with a high level of shape accuracy is enabled as a result. Being separated as a result, the sheet region can then be manufactured so that this can also be produced individually and more simply. Moreover, an embodiment of this type means that it then also becomes possible for the sheet region on one hand and the strip on the other hand to be able to be manufactured out of different materials. As a result, individual aspects can be taken into account in functional terms. Thus, for example, the strip can then be manufactured out of plastic so that it is realized so as to be mechanically very stable. As a result, a safe and loadable connection to the sheet region can be manufactured, and on the other hand corresponding forces can also be absorbed if a drawer is pushed in relatively firmly and then impacts against this strip. A further advantage is achieved in situations of this type precisely by using the elastically deformable stop element since certain forces acting in the case of an impact of this type are also absorbed by using this deformation elasticity.

Preferably, this strip has a slot into which the sheet region is inserted with its foremost edge. This means that a fast and yet highly functional and continuously loadable physical connection is enabled between the strip and the sheet region.

Preferably, provision is made that an elastic retaining element is disposed at least on one inner side of a wall of the strip delimiting the slot. In particular this retaining element is realized in the form of an anti-slip element in order to enable a positional safeguard between the strip and the sheet region in the assembled state.

Preferably, the retaining element is realized out of a material with a high friction coefficient.

Provision is made in particular that the retaining element is realized on an inner side of a cover wall delimiting the slot. The retaining element preferably extends over at least 50 percent, in particular at least 70 percent, in particular at least 80 percent, in particular at least 90 percent of the length of this wall delimiting the slot as measured in the direction of the longitudinal axis of the strip.

Additionally or in place of this, provision can also be made that an elastic retaining element of this type is disposed on an inner side of a bottom wall delimiting the slot. The retaining element is preferably realized in the form of a linear band. Preferably the material of the retaining element is different from the material of a support part of the strip, which supports the retaining element.

An advantageous embodiment provides that the strip is realized in the form of a one-piece part at least with the retaining element. Particularly advantageous in this context is an embodiment in the form of a two-component extrusion part. A simple, accurately shaped embodiment is enabled as a result.

Preferably provision is made that the elastically deformable stop element is disposed on a foremost edge of the strip, which foremost edge faces away from the sheet region. An embodiment of this type means that this elastically deformable stop element can be disposed in an exposed and mechanically stable manner on what is once again, seen in itself, a very stable element, specifically the strip. Since the strip is preferably realized out of plastic, the mechanical fixing of this elastically deformable stop element can then also be effected in an advantageous manner in this case, and is in particular then also simpler than in the case of a fixing on the sheet region, which is realized for example out of genuine glass. Since this foremost edge of the strip, seen in itself, can then also be realized to be larger than a foremost edge of a sheet region, the stable and safe fixing of the stop element on this foremost edge of the strip is likewise advantageous.

Provision can be made that the strip is realized in the form of a one-piece part with the elastically deformable stop element, in particular in the form of a multi-component extrusion part. If, in an advantageous embodiment, the plastic material of the elastically deformable stop element and of the aforesaid advantageous retaining element is the same, the strip can be realized with the retaining element and with the elastically deformable stop element in particular in the form of a two-component extrusion part.

In a further advantageous embodiment, the sheet region is realized out of genuine glass. As a result, it can also be realized so as to be transparent so that light can shine through. As a result, the general brightness of the receiving space is improved, and then in particular a view from above through the sheet region into the drawer is also enabled.

Provision is preferably made that, when viewed in the height direction of the domestic refrigeration appliance, the sheet region and an upper edge of the front wall of the drawer are disposed at the same height. This is advantageous in particular in order not to generate an unwanted offset in this case so that in the case of removal of stored goods from the compartment floor, no unwanted impacting on the upper edge of the front wall occurs, which likewise applies whenever the compartment floor is to be stocked with stored goods. This height orientation is also advantageous in particular in cases where the cover is movable relative to the drawer in the height direction and therefore can be raised and lowered. In particular this equal height between the upper edge of the front wall and the sheet region can then be realized in a base position of the cover for example. This type of a height adjustment of the cover is advantageous where the drawer is realized together with the cover in the form of a fresh food compartment of the domestic refrigeration appliance. A fresh food compartment of this type is realized for accommodating specific foods, which can then be kept fresh longer in this fresh food compartment by setting individual storage conditions, in particular individual humidity and/or temperature. These storage conditions can then be set independently of the remaining volume of the receiving space.

An advantageous embodiment provides that a rear side of the front wall of the drawer is realized obliquely so that the front wall tapers toward an upper edge. Precisely the handle functionality is again improved as a result.

An advantageous embodiment provides that the lowering segment is realized in a respective spoiler-shaped or chute-shaped manner. An embodiment of this type means that precisely in the upper region of the lowering segment a greater depth, as measured in the depth direction, is realized than in a region of the lowering segment located further down, as measured in the height direction. A tapering handle recess is then formed, when viewed downward in the height direction, precisely in effective connection with the front wall of the drawer when the drawer is in the closed state. A very simple and accurate engagement in the handle recess from above is enabled since therefore its handle recess opening is dimensioned relatively wide when viewed in the depth direction, and in this case also a problem-free engagement with play is enabled for a user. On one hand, the tapering of the handle recess downward means that the useful volume of the drawer is not undesirably impaired by this lowering segment. On the other hand, abrupt steep walls and therefore in such a case unwanted extremities can then also be avoided. With reference to its chute-shaped embodiment the lowering segment therefore has an embodiment which has an oblique wall and then at the lower end in turn, a respectively horizontal or less obliquely inclined joining wall.

A further independent aspect of the invention relates to a domestic refrigeration appliance including a receiving space for food, a drawer in the form of a food container which is disposed so as to be movable in the receiving space, a compartment floor which is disposed in the receiving space and which forms a cover for the drawer, an elastically deformable stop element which faces a front wall of the drawer is disposed on a front edge of the compartment floor, the compartment floor has a strip on its foremost region, which faces the front wall, an elastically deformable stop element is disposed on a respective front edge or foremost edge of the strip facing the front wall, and the strip is realized with the stop element in the form of at least a two-component extrusion part. A simple and stable embodiment of a specific region of the compartment floor is enabled as a result.

Embodiments of the first independent aspect of the invention are to be regarded as advantageous embodiments of the further independent aspect of the invention.

The designations "up," "down," "front," "rear," "horizontal," "vertical," "depth direction," "width direction," "height direction," etc. designate the given positions and orientations during use as intended and configuration as intended, of the appliance.

Further features of the invention arise from the claims, the figures, and the description of the figures. The features and feature combinations stated above in the description, and also the features and feature combinations stated below in the description of the figures and/or shown singly in the figures can be used not only in the respectively stated combination but also in other combinations without departing from the scope of the invention. Embodiments of the invention which are not explicitly shown and explained in the figures but which arise and can be generated from the explained embodiments by using separate feature combinations are therefore also to be regarded as included and disclosed. Embodiments and feature combinations which therefore do not have all of the features of an originally formulated independent claim are also to be regarded as disclosed. Moreover, embodiments and feature combinations which go beyond or diverge from the feature combinations set forth in the cross-references of the claims are to be seen as disclosed in particular by using the embodiments set forth above.

Other features which are considered as characteristic for the invention are set forth in the appended claims.

Although the invention is illustrated and described herein as embodied in a domestic refrigeration appliance with a specific front-side lowering segment of a compartment floor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
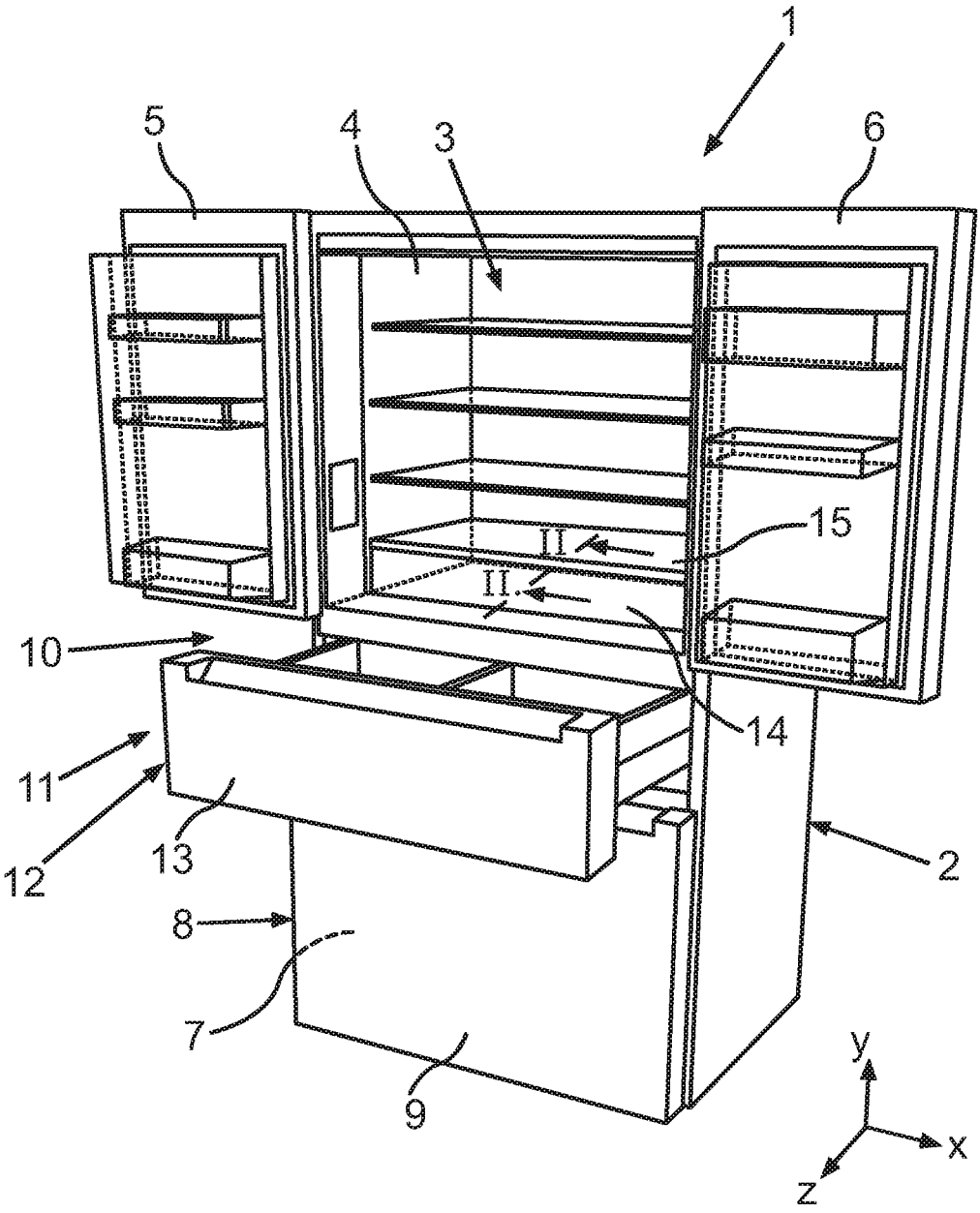
FIG. 1 is a diagrammatic, perspective view of an exemplary embodiment of a domestic refrigeration appliance according to the invention.

Referring now in detail to the figures of the drawings, in which identical or functionally identical elements are labeled with the same reference characters, and first, particularly, to FIG. 1 thereof, there is seen an exemplary embodiment of a domestic refrigeration appliance 1 in a perspective view. The domestic refrigeration appliance 1 is realized in functional terms for storing and preserving food. In the exemplary embodiment the domestic refrigeration appliance 1 is realized in the form of a combined refrigerator/freezer appliance. However, it can also be realized as just a refrigerator or as just a freezer.

The domestic refrigeration appliance 1 has a casing 2 in which a first receiving space 3 for storing and preserving food is realized. In the exemplary embodiment the receiving space 3 is a refrigerator compartment. It is delimited by walls of an inner container 4. On the front side the receiving space 3 can be closed by at least one door, and by two separate doors 5 and 6 in the exemplary embodiment. In FIG. 1 the doors 5 and 6 are shown in the open state. The doors 5 and 6 can be pivoted in each case around a pivot axis oriented in the height direction (y direction) of the domestic refrigeration appliance 1. The doors are disposed in a pivoting manner on the casing 2.

In the exemplary embodiment the domestic refrigeration appliance 1 additionally has a further receiving space 7, which is separated from the first receiving space 3. The further receiving space 7 is a freezer compartment in the exemplary embodiment. In particular, provision is made in the embodiment shown that the freezer compartment is realized below the refrigerator compartment when viewed in the height direction. The second receiving space 7 is likewise delimited by walls of the inner container 4 or by walls of a respectively separate inner container, and the further receiving space 7 can be closed at the front side by using its own separate door 8. In the exemplary embodiment the further door 8 is realized in the form of a front wall 9 of a drawer, which can be pushed in and pulled out in the further receiving space 7, and therefore can be moved in a linear manner in the depth direction (z direction).

The door 8 is shown in the closed state in the diagram according to FIG. 1. Stored goods in the form of foodstuffs, such as foods and drinks, can likewise be stored and preserved in the further receiving space 7, in particular at lower temperatures than is the case in the refrigerator compartment.

In the exemplary embodiment the domestic refrigeration appliance 1 moreover preferably has at least one additional function compartment 10. In the exemplary embodiment shown in FIG. 1 the function compartment 10 is disposed between the refrigerator compartment and the freezer compartment when viewed in the height direction. Provision can preferably be made that the function compartment 10 represents a partial volume separated from the remaining partial volume of the first receiving space 3, and therefore is also realized more or less within the overall volume of the receiving space 3. In particular the function compartment 10 has a drawer 11 in this case. The function compartment 10 can be closed at the front side by a door 12, in which this door 12 represents a front wall 13 of the drawer 11.

Moreover, the domestic refrigeration appliance 1 has a drawer 14 which is realized in the form of a food container. In the exemplary embodiment the drawer 14 is realized in the receiving space 3. Moreover, the domestic refrigeration appliance 1 has a compartment floor 15 which is realized in the form of a cover for the drawer 14. This therefore means that when viewed in the height direction of the domestic refrigeration appliance 1, the cover 15 is disposed directly above the drawer 14. The quantity of receiving spaces, their position, and also the quantity and nature of the doors is likewise not to be understood as definitive in any way, like the position of the drawer 14 and the compartment floor 15. Many other embodiments are also possible in this case.

Figure 2:
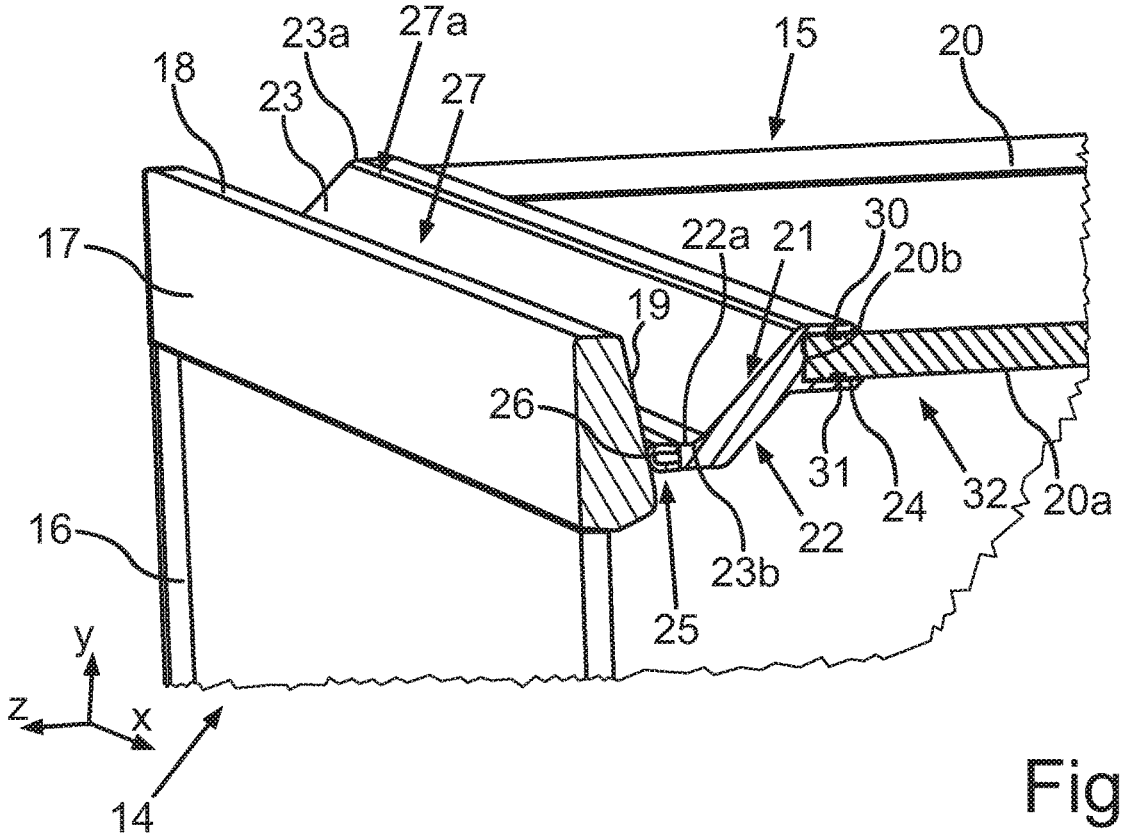
FIG. 2 is an enlarged, fragmentary, partly-sectional, perspective view of an exemplary embodiment of a drawer and a compartment floor of the domestic refrigeration appliance according to FIG. 1.

FIG. 2 shows a configuration with the drawer 14 and the compartment floor 15 in a perspective sectional diagram taken along the section line II-II in FIG. 1. The drawer 14 is shown in this case in the pushed-in and therefore completely closed state. The drawer 14 has a front wall 16. In this exemplary embodiment a bar 17 is realized in an upper region of the front wall 16 viewed in the height direction. The bar 17 can be put on as a separate part, but can also be realized as integral or in one piece with the remaining region of the front wall. This bar 17 has an upper edge 18. Moreover, this bar 17 has a rear side 19 which faces the compartment floor 15. As can be seen, this rear side 19 is preferably not oriented strictly vertically in this case, but instead it is inclined obliquely. In this regard the slope is such that the bar 17 tapers toward the upper edge 18.

Moreover, it can be seen that the compartment floor 15 has a sheet region 20. In particular this sheet region 20 is realized so as to be flat in this case. The sheet region 20 is preferably made of genuine glass in this case. Moreover, the compartment floor 15 has a lowering segment 21. In the illustrated exemplary embodiment the lowering segment 21 is realized in a single piece in a strip 22 and is therefore integrated. The strip 22 is a part which is separate from the sheet region 20 in this case. In particular the strip 22 is realized in a single piece, in particular made of plastic. The lowering segment 21 is realized in a spoiler-like or respectively chute-like manner in this case. This means that it has an oblique wall 23 in the exemplary embodiment shown herein. The oblique wall 23 is oriented in this case in such a way that an upper end 23*a*, when viewed in the height direction, is offset further backward when viewed in the depth direction, as compared to a lower end 23*b* of this oblique wall 23. As can be seen the lowering segment 21 is moreover formed in such a way that the lower end 23*b* of this oblique wall 23 is disposed further down or is respectively disposed at a lower height than a lower side 20*a* of the sheet region 20.

Moreover, the lowering segment 21 has a slot 24 on its rearmost end, viewed in the depth direction (z direction), which end faces away from the front wall 16. A foremost edge 20*b* of the sheet region 20 is inserted into this slot 24.

An elastically deformable stop element 26 is disposed on a front edge 25 of the compartment floor 15. In the illustrated exemplary embodiment, this front edge 25 is formed by a foremost edge 22*a* of the strip 22. The elastically deformable stop element 26 is therefore, when viewed in the height direction, disposed offset backward and downward both with respect to the sheet region 20 and also with respect to the upper edge 18. When the drawer 14 is in the closed state, as shown in FIG. 2, the elastically deformable stop element 26 abuts against the rear side 19. In this case the elastically deformable stop element 26 is in particular a seal, especially a hollow seal, which is realized in a U-shape in cross-section, in particular in the form of a U lying on its side.

A handle recess 27, which can be engaged from above, is realized by the lowering segment 21 and the front wall 16, in particular the rear side 19, as shown in FIG. 2. The preferably obliquely realized rear side 19 and/or the specific orientation and embodiment of the lowering segment 21 mean that this handle region or respectively this handle recess 27 is realized with a greater width at its upper region and therefore at a handle region opening 27*a*, when viewed in the depth direction, than in the lower region of the handle recess 27. The handle recess 27 therefore tapers downward viewed in the height direction. The handle recess 27 is delimited in the forward direction by the front wall 16 and in the rearward direction by the lowering segment 21, in particular the oblique wall 23, when viewed in the depth direction.

Figure 3:
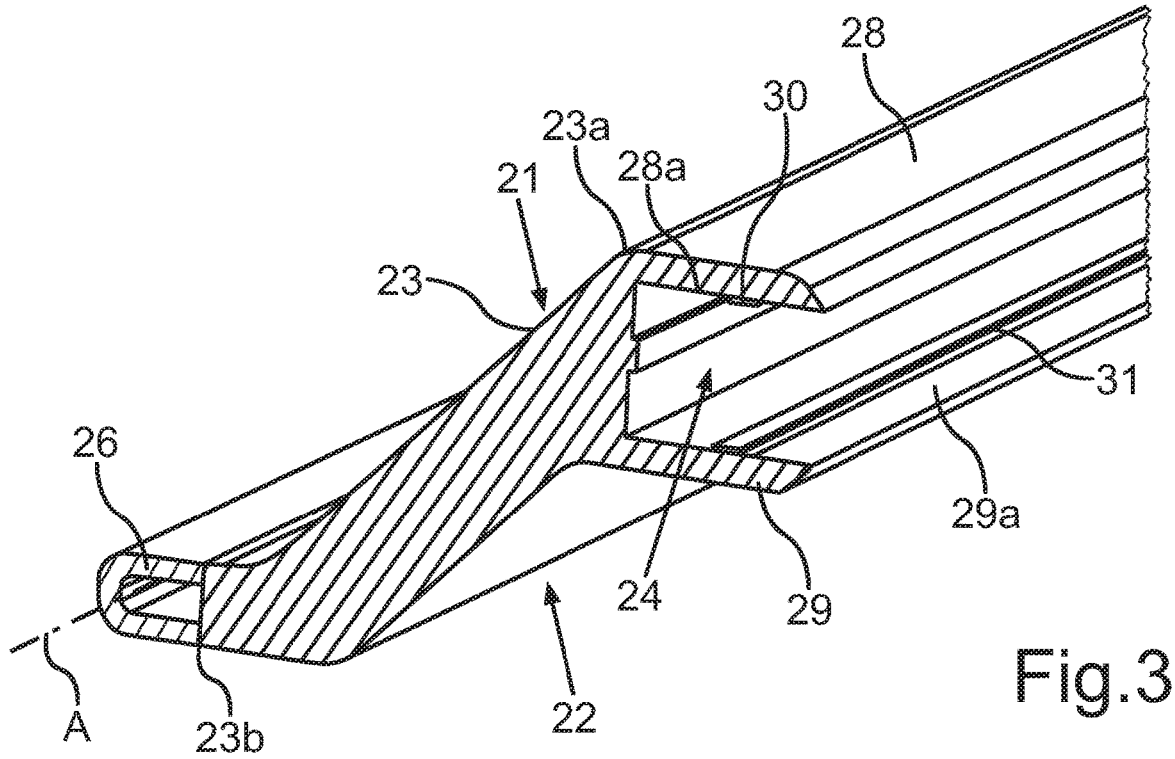
FIG. 3 is a further enlarged, fragmentary, partly-sectional, perspective view through a sub-element of the compartment floor according to FIG. 2.

FIG. 3 shows an enlarged perspective sectional diagram of the strip 22. The hollow and in particular U-shaped embodiment of the elastically deformable stop element 26 can be seen therein. The elastically deformable stop element 26 is realized with a longitudinal axis A and preferably extends over the entire width, as measured in the width direction (x direction), of the foremost edge 22*a*. As can also be seen moreover, the chute-like or respectively ski-jump-like embodiment means that an orientation realized in the depth direction, and therefore a forward projecting configuration of the seal in the shape of the elastically deformable stop element 26, is achieved. The U-shape of this stop element 26 is oriented in such a way that the U-limbs end at this foremost edge 22*a*.

As can be seen moreover, the slot 24 is delimited by a top wall 28 and a bottom wall 29. A retaining element 30 is realized on an inner side 28*a* of this top wall 28. This retaining element 30 is preferably realized so as to be elastic and structured in the form of an anti-slip element. In addition to or in place of this, an elastic retaining element 31 can also be realized on an inner side 29*a* of the bottom wall 29. In particular the retaining element is also structured correspondingly to the retaining element 30 in functional and material terms. The retaining elements 30 and 31 are realized in the form of band elements and in each case are realized so as to be standing and raised up above the inner sides 28*a* and 29*a*.

Provision is made in particular that the strip 22 is realized with a retaining element 30 and/or 31 in the form of a 2-component extrusion part. Provision is made in particular that the strip 22 is realized in a single piece, in particular in the form of a 2-component extrusion part, both with a retaining element 30 and/or 31 and also with the elastically deformable stop element 26. FIG. 2 and FIG. 3 also show the Z-shaped embodiment of the strip 22 with the elastically deformable stop element 26.

In particular a retaining element 30 and/or 31 can be realized out of a soft component with a raised friction coefficient. For example, the material can be TPE (thermoplastic elastomer). A corresponding material can be provided for the elastically deformable stop element 26.

With at least one retaining element 30 and/or 31 it is in particular no longer necessary to mill recesses in the sheet region 20 and to provide latching devices engaged into the milled recesses for the purpose of positionally fixing the components to each other.

As can be seen from FIGS. 2 and 3 the lowering segment 21 is disposed on a foremost region 32 of the compartment floor 15.

The following is a summary list of reference numerals and the corresponding structure used in the above description of the invention:

1 Domestic refrigeration appliance
2 Casing
3 Receiving space
4 Inner container
5 Door
6 Door
7 Receiving space
8 Door
9 Front wall
10 Function compartment
11 Drawer
12 Door
13 Front wall
14 Drawer
15 Compartment floor
16 Front wall
17 Bar
18 Upper edge
19 Rear side
20 Sheet region
20*a* Lower side
20*b* Foremost edge
21 Lowering segment
22 Strip
22*a* Foremost edge
23 Oblique wall
23*a* Upper end
23*b* Lower end
24 Slot
25 Front edge
26 Stop element
27 Handle recess
27*a* Handle region opening
28 Top wall
28*a* Inner side
29 Bottom wall
29*a* Inner side
30 Retaining element
31 Retaining element
32 Foremost region

The invention claimed is:

1. A domestic refrigeration appliance, comprising:

a receiving space for food;

a drawer movably disposed in said receiving space as a food container, said drawer having a front wall with a rear side and an upper edge;

a compartment floor disposed in said receiving space and forming a cover for said drawer, said compartment floor having a front edge, said compartment floor having a foremost region facing said front wall of said drawer, and said compartment floor having a sheet region;

said compartment floor having a lowering segment on said foremost region, said lowering segment having a foremost rim being lowered downward relative to said sheet region;

said lowering segment and said front wall of said drawer forming a handle recess configured to be engaged from above when said drawer is in a closed state;

an elastically deformable stop element of said lowering segment facing said front wall of said drawer and being disposed at said front edge of said compartment floor, said elastically deformable stop element being disposed on said foremost rim;

said stop element abutting against said rear side of said front wall of said drawer and being offset downward relative said upper edge of said front wall in a height direction of the domestic refrigeration appliance when said drawer is in said closed state; and said lowering segment being a strip implemented as a part that is separate from said sheet region, and said lowering segment including an obliquely inclined portion directly adjacent said sheet region, wherein said obliquely inclined portion at least partially forms said handle recess.

2. The domestic refrigeration appliance according to claim 1, wherein said stop element is a seal.

3. The domestic refrigeration appliance according to claim 1, wherein said stop element has a longitudinal axis and a U-shaped cross-section perpendicular to said longitudinal axis.

4. The domestic refrigeration appliance according to claim 1, wherein said sheet region has a foremost edge, and said compartment floor has said separate strip disposed on said foremost edge of said sheet region, said lowering segment being integrated in said separate strip.

5. The domestic refrigeration appliance according to claim 4, wherein said separate strip has a slot into which said foremost edge of said sheet region is inserted.

6. The domestic refrigeration appliance according to claim 5, wherein:

said separate strip has a wall delimiting said slot, said wall has inner sides; and an elastic retaining element is disposed on at least one of said inner sides providing an anti-slip element for safeguarding against slipping between said separate strip and said sheet region.

7. The domestic refrigeration appliance according to claim 4, wherein said separate strip and at least said elastically deformable stop element form a one-piece part.

8. The domestic refrigeration appliance according to claim 4, wherein said separate strip and at least said elastically deformable stop element form a two-component extruded part.

9. The domestic refrigeration appliance according to claim 4, wherein said separate strip has a foremost edge facing away from said sheet region, and said elastically deformable stop element is disposed on said foremost edge of said separate strip.

10. The domestic refrigeration appliance according to claim 1, wherein said sheet region is made of genuine glass.

11. The domestic refrigeration appliance according to claim 1, wherein said front wall of said drawer has an upper edge, and said sheet region and said upper edge of said front wall of said drawer are disposed at an identical height in a height direction of the domestic refrigeration appliance.

12. The domestic refrigeration appliance according to claim 1, wherein said rear side of said front wall of said drawer is disposed obliquely causing said front wall to taper toward said upper edge of said front wall.

13. The domestic refrigeration appliance according to claim 1, wherein said lowering segment is chute-shaped.

14. The domestic refrigeration appliance according to claim 1, wherein said elastically deformable stop element is a seal having a thickness that is not greater than a thickness of said sheet region of said compartment floor.

* * * * *